US010186388B2

(12) United States Patent
Amirthasamy et al.

(10) Patent No.: US 10,186,388 B2
(45) Date of Patent: Jan. 22, 2019

(54) VISUAL INDICATOR MODULES FOR USE WITH CONTROL PANELS AND RELATED METHODS

(71) Applicant: Fisher Controls International LLC, Marshalltown, IA (US)

(72) Inventors: Stanley Felix Amirthasamy, Ames, IA (US); Pei Li, Guangdong (CN); Marwan Brama, Singapore (SG)

(73) Assignee: FISHER CONTROLS INTERNATIONAL LLC, Marshalltown, IA (US)

( * ) Notice: Subject to any disclaimer, the term of this patent is extended or adjusted under 35 U.S.C. 154(b) by 0 days.

(21) Appl. No.: 15/570,994

(22) PCT Filed: Sep. 9, 2015

(86) PCT No.: PCT/CN2015/089240
§ 371 (c)(1),
(2) Date: Oct. 31, 2017

(87) PCT Pub. No.: WO2017/041245
PCT Pub. Date: Mar. 16, 2017

(65) Prior Publication Data
US 2018/0114653 A1 Apr. 26, 2018

(51) Int. Cl.
*H01H 9/16* (2006.01)
*G08B 5/36* (2006.01)
(Continued)

(52) U.S. Cl.
CPC ..... *H01H 9/162* (2013.01); *G08B 5/36* (2013.01); *H01H 9/161* (2013.01); *H01H 13/023* (2013.01); *H01H 13/06* (2013.01)

(58) Field of Classification Search
CPC ..... H01H 9/162; H01H 13/023; H01H 13/58; H01H 2013/026; H01H 21/025; G08B 5/36; H02B 1/044
(Continued)

(56) References Cited

U.S. PATENT DOCUMENTS 4,191,871 A * 3/1980 Coyle ..... H01H 1/403 200/303
4,354,077 A * 10/1982 McMains ..... H01H 13/83 200/292
(Continued)

FOREIGN PATENT DOCUMENTS

CN 103137351 6/2013
CN 203426625 2/2014
(Continued)

OTHER PUBLICATIONS

International Searching Authority, "International Search Report," issued in connection with International Application No. PCT/CN2015/089240, dated Jun. 12, 2016, 4 pages.
(Continued)

*Primary Examiner* — Emily C Terrell
(74) *Attorney, Agent, or Firm* — Hanley, Flight and Zimmerman, LLC

(57) ABSTRACT

An example visual indicator includes a base defining a light chamber and a first cover removably coupled to the base to cover the light chamber. A light assembly is positioned in the light chamber of the base. The light assembly has a first connector projecting from the base and the first connector is to pass through an access opening formed in an outer surface of a control panel when the visual indicator is coupled to the control panel. The base is to engage the outer surface of the control panel when the visual indicator is coupled to the control panel. The visual indicator is to enable an ingress protection rating of the control panel to be maintained when
(Continued)

at least one of the visual indicator is removed from the control panel or the first cover of the visual indicator is replaced with a second cover different than the first cover.

25 Claims, 11 Drawing Sheets

(51) Int. Cl.
*H01H 13/02* (2006.01)
*H01H 13/06* (2006.01)

(58) Field of Classification Search
USPC ..... 340/815.9, 815.5
See application file for complete search history.

(56) References Cited

U.S. PATENT DOCUMENTS

2010/0171889 A1* 7/2010 Pantel ..... G02F 1/133308 349/1
2014/0313775 A1* 10/2014 Myers ..... F21S 8/026 362/612
2016/0079015 A1* 3/2016 Bauer ..... H01H 23/025 200/17 R

FOREIGN PATENT DOCUMENTS

| | | |
|---|---|---|
| CN | 104577564 | 4/2015 |
| CN | 204315425 | 5/2015 |
| CN | 104791741 | 7/2015 |
| CN | 204441645 | 7/2015 |

OTHER PUBLICATIONS

International Searching Authority, "Written Opinion," issued in connection with International Application No. PCT/CN2015/089240, dated Jun. 12, 2016, 4 pages.
Metso, "Local Control Panels for VG9000H LCP9H Series," Mar. 2015, 12 pages.

* cited by examiner

VISUAL INDICATOR MODULES FOR USE WITH CONTROL PANELS AND RELATED METHODS

FIELD OF THE DISCLOSURE

This patent relates generally to visual indicators and, more particularly, to visual indicator modules for use with control panels and related methods.

BACKGROUND

Electronic control panels enable manual operation and/or provide visual indication of a status of a device or system. Additionally, some control panels employ enclosures configured to withstand harsh environmental conditions. For example, control panels employed in offshore drilling applications require ingress protection to protect electronic components (e.g., a printed circuit board, lights, pushbuttons and/or other components) positioned or housed inside an enclosure or casing from corrosion caused by environmental conditions (e.g., humidity, salt, dust, etc.). Some control panels may include enclosures that are classified in accordance with certain standards or codes to help identify a level of ingress protection provided by the enclosure. For example, the International Electrotechnical Commission (IEC) provides ingress protection ratings or codes (e.g., ANSI/IEC ingress codes) to classify enclosures for use in certain conditions and/or applications. An IP66 rating or code, for example, requires an enclosure to withstand at least 100 liters of water per minute for a three minute duration and/or a water jet or spray having 100 kPa of pressure at a distance of 3 meters for at least three minutes.

SUMMARY

An example visual indicator disclosed herein includes a base defining a light chamber and a first cover removably coupled to the base to cover the light chamber. A light assembly is positioned in the light chamber of the base. The light assembly has a first connector projecting from the base and the first connector is to pass through an access opening formed in an outer surface of a control panel when the visual indicator is coupled to the control panel. The base is to engage the outer surface of the control panel when the visual indicator is coupled to the control panel. The visual indicator is to enable an ingress protection rating of the control panel to be maintained when at least one of the visual indicator is removed from the control panel or the first cover of the visual indicator is replaced with a second cover different than the first cover.

An example control panel assembly disclosed herein includes a first housing portion having a rear cover removably coupled to a housing to form a main cavity. A light panel is removably coupled to the housing to define a secondary cavity. The light panel has an access port through an outer surface of the light panel to enable access to a first electrical connector positioned in the secondary cavity. A visual indicator is removably coupled to the outer surface of the light panel. The visual indicator has a light assembly including a second connector, where the second connector couples to the first connector positioned in the secondary cavity via the access port when the visual indicator is coupled to the light panel.

An example visual indicator assembly includes a base having a flange, a wall projecting from a first side of the flange to define a light chamber, and an opening formed in a second side of the flange in communication with the light chamber. A support plate is coupled to the base, where the support plate is supported by a platform formed in the light chamber. A light source is coupled to the support plate and positioned within the light chamber. A first connector is coupled to the support plate and projects through the opening formed in the second side of the flange, where the first connector is electrically coupled to the light source. A first lens is removably coupled to the base such that the first lens covers the light chamber when the first lens is coupled to the base. The first lens is interchangeable with a second lens that is different than the first lens when the base is coupled to a control panel.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
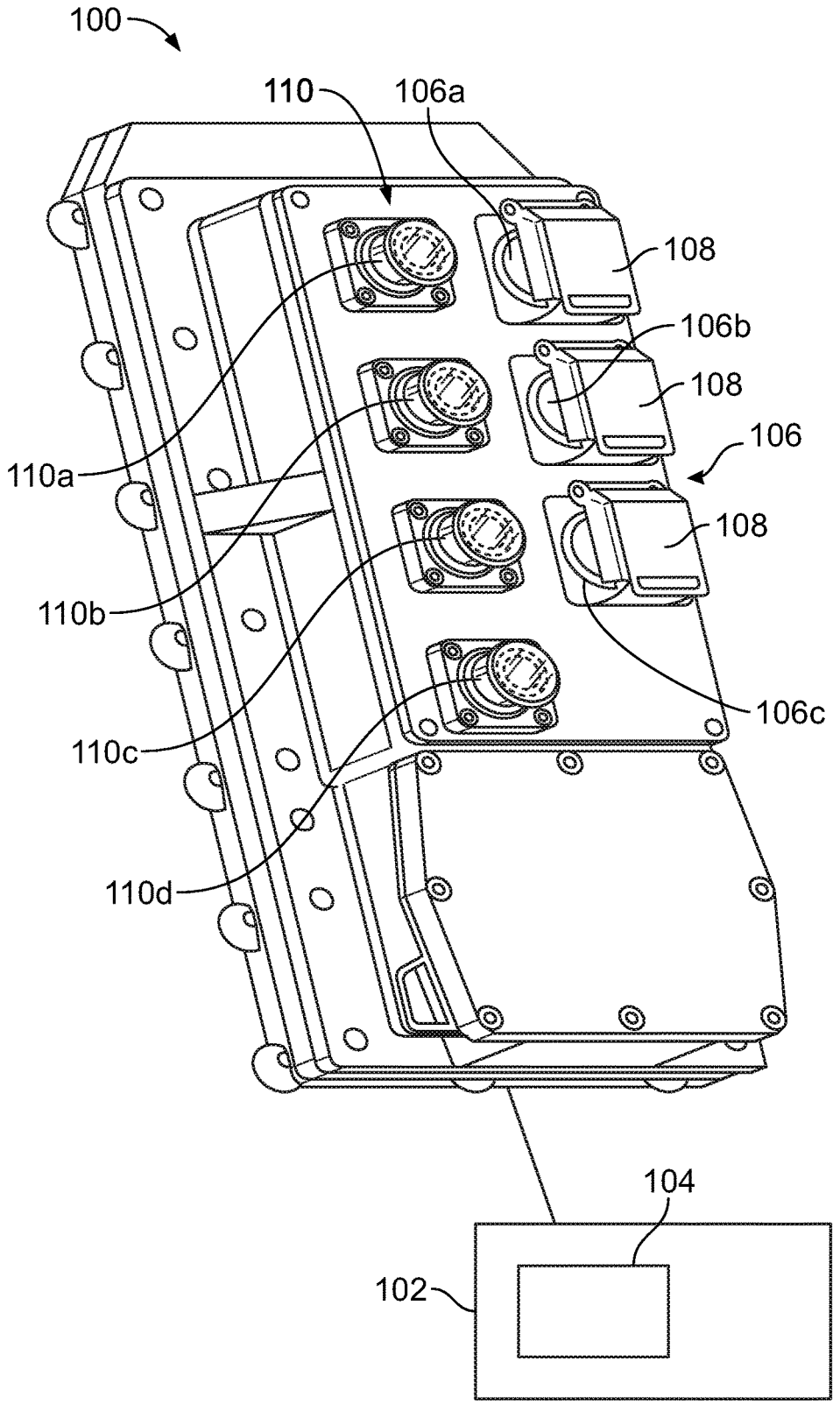
FIG. 1 illustrates an example control panel in accordance with the teachings of this disclosure.

Fluid control devices (e.g., safety shutdown valves) typically have associated instruments such as a valve position controller to control the fluid device and/or transmit information about a status of the fluid device. In some instances, a control panel may be used in conjunction with a valve controller (e.g., a safety instrument system digital valve controller) to manually operate the fluid control device (e.g., a safety shutoff value). In some such examples, the control panel may employ pushbuttons to open, close and/or test the fluid device operatively coupled to the control panel via the valve controller. The control panel may also include one or more indicator lights to provide visual indication of a valve being in an open position, a closed position, and/or a test mode.

The visual indicator cover of some example control panels or enclosures may be glued to an inner surface of the enclosure (e.g., an inner surface of a front cover) and/or may be coupled to an inner surface of a front panel or cover via a lock-ring. To replace a visual indicator cover or indicator light of some control panels, the enclosure is unsealed (e.g., removing a front cover from a back cover and/or from a housing). However, an enclosure that is unsealed may compromise an ingress protection and/or an ingress protection rating of the enclosure. As a result, replacing a light bulb or light source and/or a light cover of a visual indicator often compromises an ingress protection and/or an ingress protection rating of the enclosure or the control panel.

The example enclosures and related methods disclosed herein enable interchangeability of an indicator light and/or an indicator cover of a control panel while maintaining an enclosure ingress protection (e.g., an ingress protection rating). To maintain the ingress protection ratings, the example enclosures and related methods disclosed herein remain sealed when a light module is coupled or decoupled from the control panel. In particular, the example control panels disclosed herein employ a light module that is removably coupled to an outer surface (e.g., a front cover) of a control panel. By removably coupling the light module to the front cover via the outer surface, the example light module disclosed herein is positioned outside an enclosure of the control panel. Thus, any electronic components positioned within the enclosure remain sealed (e.g., factory sealed) when the light module is coupled or decoupled from the control panel. In other words, the enclosure maintains a classification or rating when the light module is removably coupled or decoupled from the control panel and/or replaced with a different light module. As a result, achieving light color interchangeability and/or light replacement without interfering with an ingress protection of an enclosure ensures protection to the electronic components against humidity and other harsh environmental conditions while enabling flexibility of configuring a color scheme and/or indicator light replacement in the field.

FIG. 1 illustrates an example control panel 100 in accordance with the teachings of this disclosure. In some examples, the control panel 100 is configured to maintain an ingress protection rating by enabling some components (e.g., light covers, light modules) to be easily interchanged in the field while substantially preventing environmental conditions from permeating ingress protection material within the control panel 100 and/or compromising the ingress protection rating of the control panel 100. The control panel 100 of FIG. 1 may be used to enable manual operation of a device or system coupled to the control panel 100. For example, the control panel 100 may enable manual operation of a fluid control device 102 (e.g., a safety shutoff valve) that is typically operated via a valve position controller 104. In some instances, the control panel 100 may be positioned in a remote location relative to the fluid control device 102 to facilitate access to the control panel 100.

To enable or initiate manual operation of the fluid control device 102 (e.g., a valve) via the control panel 100, the control panel 100 of the illustrated example includes one or more pushbuttons 106. For example, the pushbuttons 106 of the control panel 100 may be employed to manually initiate a full stroke and/or a partial stroke of the fluid control device 102, perform a test operation on the fluid control device 102, perform a manual reset operation, etc. The control panel 100 of the illustrated example employs a first pushbutton 106*a* to move the fluid control device 102 to an open position and/or a closed position, a second pushbutton 106*b* to initiate testing of the fluid control device 102, and a third pushbutton 106*c* to reset the fluid control device 102. The control panel 100 of the illustrated example includes covers 108 to protect the pushbuttons 106*a-c*. Additionally, the covers 108 may be locked to prevent unauthorized access to the pushbuttons 106*a-c*.

The control panel 100 of the illustrated example also includes light modules or visual indicators 110 representative of an operational state of the fluid control device 102. For example, the visual indicators 110 may provide an indication that the fluid control device 102 is in open condition, a closed condition, a test condition, a reset condition and/or any other condition or operational status of the fluid flow control device 102. For example, the visual indicators 110 may provide an alarm status when the fluid control device 102 is offline and/or not operating properly. Each of the visual indicators 110 of the illustrated example illuminates a different color to identify different status and/or conditions of the fluid control device. For example, a first light or visual indicator 110*a* may emit a green color indication when the fluid control device 102 is in a normal operating state or position. A second light or visual indicator 110*b* may emit a red color indication when the fluid control device 102 is in a fail-safe state. A third light or visual indicator 110*c* may emit a yellow or orange color light when the fluid control device 102 requires a reset operation. A fourth light or visual indicator 110*d* may emit a white color light to indicate an operational status (fault condition of the control panel, instrument or shutdown valve, etc.) of the control panel 100. However, in other examples, one or more of the visual indicators 110 may have lenses or bulbs of the same or different colors. In some examples, the visual indicators 110 may be configured to provide a patterned output. For example, the visual indicators 110 vary a blinking frequency of light in response to a status or condition of fluid control device 102. For example, the first visual indicator 110*a* may emit a flashing green color light when the fluid control device 102 is in an incorrect operating position. In some examples, the control panel 100 may employ any number of visual indicators 110 and/or pushbuttons 106. For example, the control panel 100 may employ only one visual indicator 110 and/or only one pushbutton 106. In some examples, the control panel 100 may employ two or more visual indicators 110 and/or two or more pushbuttons 106.

Figure 2:
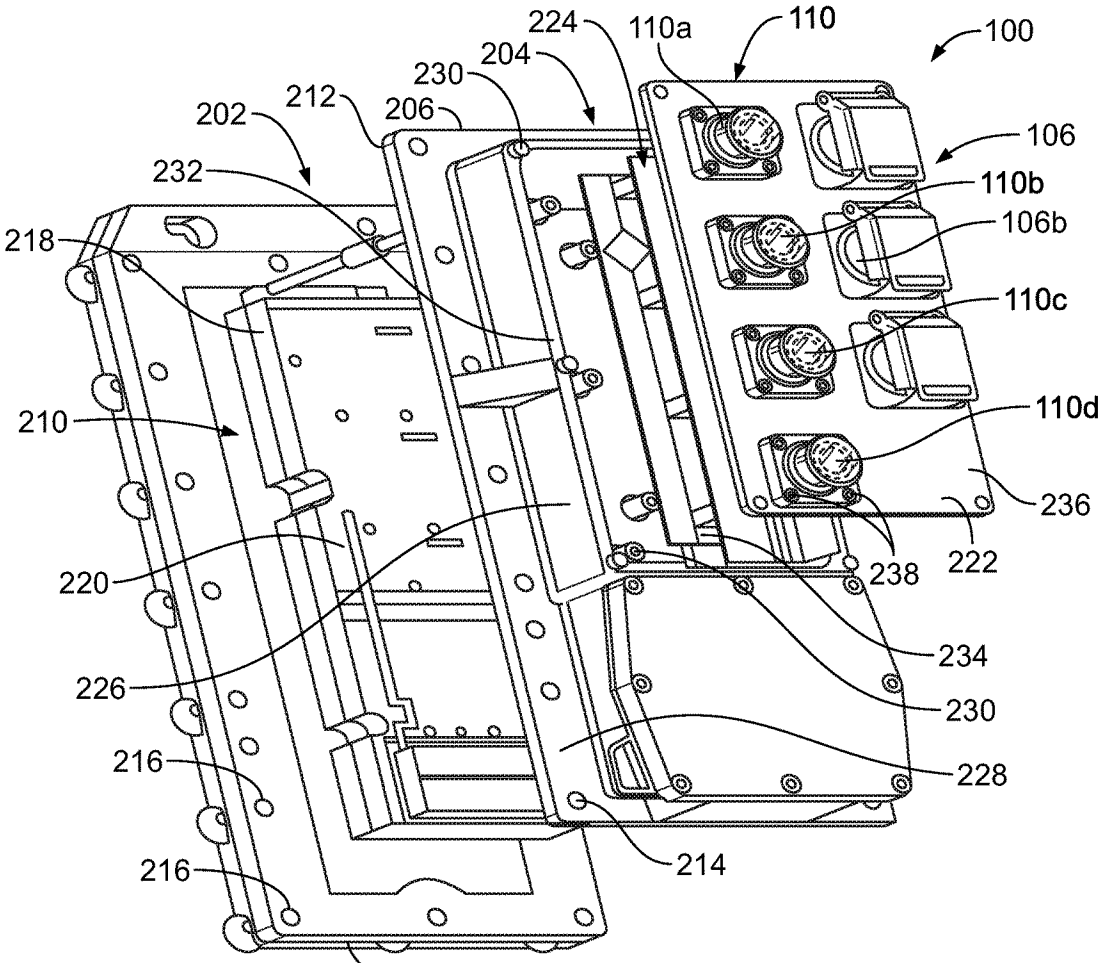
FIG. 2 is a partial exploded view of the example control panel of FIG. 1.

FIG. 2 illustrates a partial exploded view of the example control panel 100 in accordance with the teachings of this disclosure. The control panel 100 (e.g., enclosure, housing, etc.) of the illustrated example includes a first housing portion 202 and a second housing portion 204. The first housing portion 202 includes a first panel or housing 206 (e.g., a first housing) that is removably coupled to a second panel or a rear cover 208 to define a main chamber, area or cavity 210. The housing 206 includes a flanged portion 212 having apertures 214. The rear cover 208 includes apertures 216 that align with the apertures 214 to receive fasteners that couple the housing 206 and the rear cover 208. The main cavity 210 of the illustrated example receives an electronics enclosure 218 that contains primary electronic components 220 of the control panel 100. For example, the primary electronic components 220 of the illustrated example include, for example, a printed circuit board and/or other electronic components or elements of the control panel 100. The electronics enclosure 218 of the illustrated example is a housing (e.g., a two-part housing) defining an opening or cavity to receive the electronic components 220. The electronics enclosure 218 is to be filled with ingress protection material (e.g., potting, polyester, etc.) to configure the control panel 100 to meet or comply certain classifications or ratings. For example, to meet certain certifications and/or standards, the electronics enclosure 218 is filled with potting to encapsulate the electronic components 220 when the first housing portion 202 is factory sealed (e.g., the housing 206 being coupled to the rear cover 208 when the first housing portion 202 is factory sealed). For example, the control panel 100 may be configured with ingress protection in compliance with International Electrotechnical Commission IP66 rating.

The second housing portion 204 includes a front cover or light panel 222 (e.g., a light cover) coupled to the housing 206 of the first housing portion 202 to define a chamber or secondary cavity 224. More specifically, the housing 206 of the illustrated example has an annular structure or wall 226 protruding from an outer surface 228 of the housing 206 to define at least a portion of the secondary cavity 224. The light panel 222 of the illustrated example is coupled or attached to bosses 230 adjacent an upper surface 232 of the wall 226 via fasteners to enclose the secondary cavity 224. Thus, the light panel 222 may be removed from the housing 206 without having to remove the housing 206 from the rear cover 208. In this manner, the secondary cavity 224 may be exposed while the main cavity 210 remains sealed between the housing 206 and the rear cover 208. The secondary cavity 224 of the illustrated example receives secondary electronic components 234 of the control panel 100. For example, the secondary electronic components 234 of the illustrated example include electronics to operate and/or associated with the visual indicators 110. Thus, the electronic components 234 positioned in the secondary cavity 224 are operatively coupled to the electronic components 220 positioned in the main cavity 210.

The main cavity 210 is fluidly isolated and/or sealed from the secondary cavity 224. In this manner, unsealing the secondary cavity 224 in an environment having harsh conditions (e.g., salt, dust, etc.) will not compromise and/or substantially compromise an ingress protection or ingress protection classification (e.g., IP66 classification) of the main cavity 210. Thus, the main cavity 210 is separated and/or isolated (e.g., fluidly isolated or sealed) from the secondary cavity 224. In some examples, the light panel 222 can be coupled to and/or sealed with the housing 206 to comply with certain classifications or ratings.

The visual indicators 110 of the illustrated example are removably coupled to an outer surface 236 of the light panel 222 via fasteners 238. In other words, the visual indicators 110 are attached to the outer surface 236 of the control panel 100 and are not positioned inside the main cavity 210 and/or the secondary cavity 224. Thus, in this example, each of the visual indicators 110*a-d* may be removably coupled to the light panel 222 and/or (e.g., an outer surface of) the control panel 100 independently from another one of the visual indicators 110*a-d*. Further, in this example, each of the visual indicators 110*a-d* may be removed or attached to the light panel 222 and/or the control panel 100 (e.g., an outer surface of) without affecting an operation of the control panel 100 (e.g., the pushbuttons 106*a-c*) and/or without affecting the operation of the other ones of the visual indicators 110*a-d*. Thus, removal of the first visual indicator 110*a* will not affect the operation of the visual indicators 110*b*-110*c*. As a result, the visual indicators 110 of the illustrated example can be coupled to and/or decoupled from the control panel 100 without having to remove the light panel 222 from the housing 206 and/or without having to remove the rear cover 208 from the housing 206.

Figure 3:
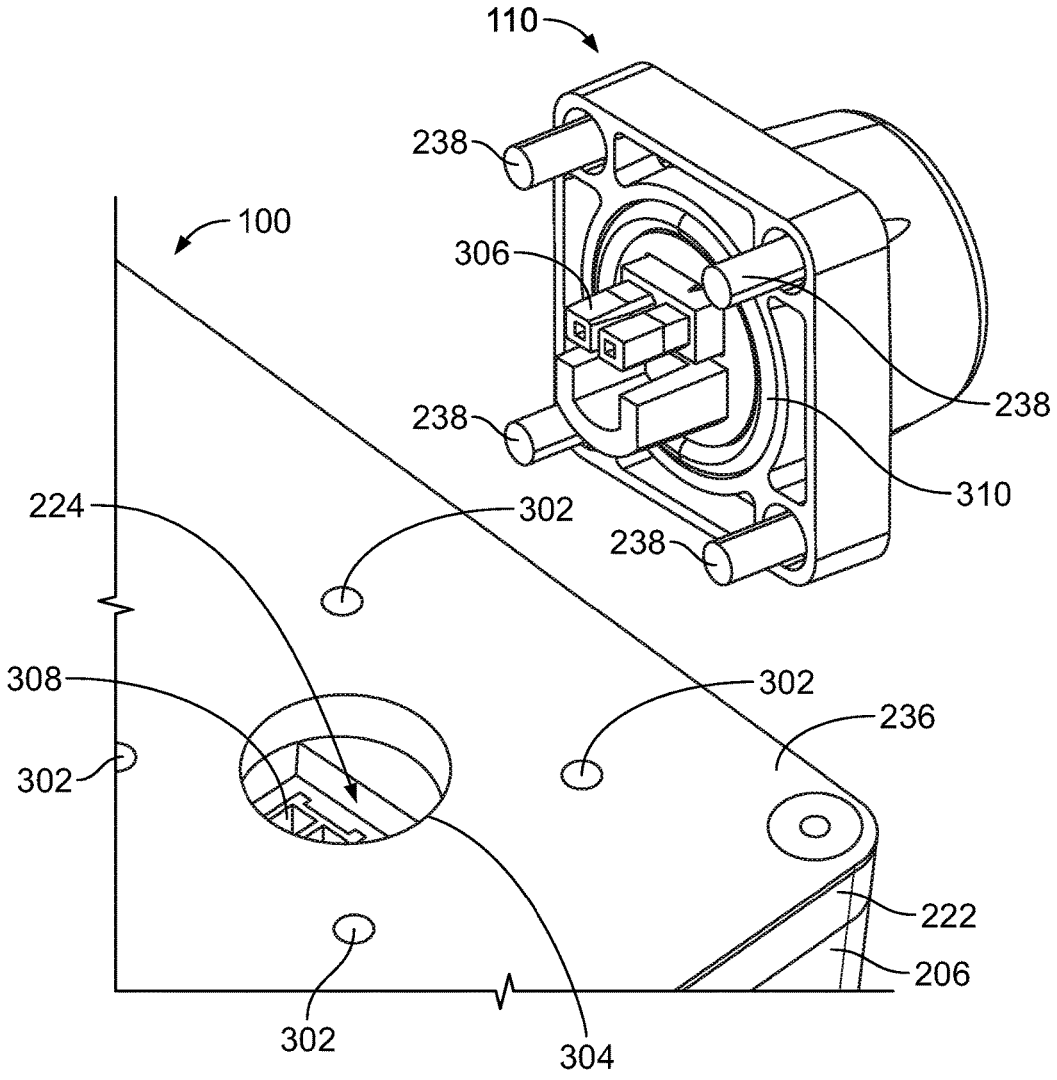
FIG. 3 illustrates an example visual indicator removed from the example control panel of FIGS. 1 and 2.

FIG. 3 is a partial perspective view of the example visual indicator 110 of FIG. 1 that is detached or decoupled relative to the control panel 100 and/or the outer surface 236 of the light panel 222. In particular, the fasteners 238 engage respective openings 302 formed in the outer surface 236 of the light panel 222. More specifically, the openings 302 of the illustrated example are formed as blind holes. In this manner, elements (e.g., weather) and/or other contaminates are prevented and/or deterred from entering into the secondary cavity 224 via the openings 302. The light panel 222 also includes an access port or opening 304 to receive a connector 306 (e.g., an electrical connector) of the visual indicator 110. The connector 306 of the illustrated example engages and/or connects to a receiving pin or connector 308 (e.g., an electrical connector) of the secondary electronic components 234 positioned in the secondary cavity 224 and accessible via the opening 304.

In the illustrated example, the visual indicator 110 includes a seal 310 (e.g., an O-ring) that engages the upper surface 236 (e.g., around a perimeter or circumference greater than a perimeter or circumference of the opening 304) of the light panel 222 to seal the opening 304 from ingress of elements and/or other contaminates into the opening 304. Thus, when the visual indicator 110 is coupled to the light panel 222 prior to installation in a harsh environment (e.g., assembled at the factory), the seal 310 maintains ingress protection and/or a certification of the control panel 100 (e.g., of the secondary cavity 224) until the visual indicator 110 is removed from the light panel 222 and the opening 304 is exposed to environmental conditions. However, as noted above, in some examples, even if the visual indicator 110 is removed from the light panel 222 in harsh environmental conditions, the removal of the visual indicator 110 from the light panel 222 does not compromise and/or does not substantially compromise the ingress protection and/or classification of the main cavity 210 because the main cavity 210 is isolated from the secondary cavity 224. In some examples, the opening 304 may include a cover to maintain and/or provide ingress protection in compliance with certain ratings (e.g., IP66) when the visual indicator 110 is removed from the control panel 100 in harsh conditions. For example, the opening 304 may include a spring biased seal (e.g., a spring biased door or gate pivotally coupled to the light panel 222 and/or the housing 206) that covers the opening 304 when the visual indicator 110 is removed from the light panel 222. In some examples, the secondary cavity 224 may be filled with ingress protection material (e.g., potting, polyester, etc.) to provide ingress protection of the secondary cavity 224 in compliance with International Electrotechnical Commission IP66 rating.

Figure 4A:
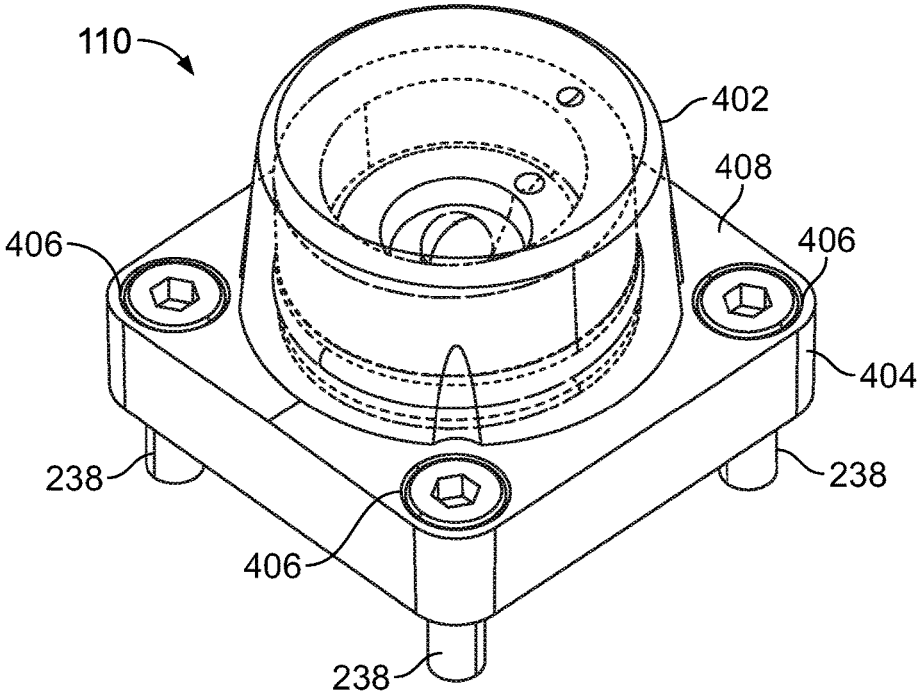
FIG. 4A is a perspective view of the example visual indicator of FIG. 3.
Figure 4B:
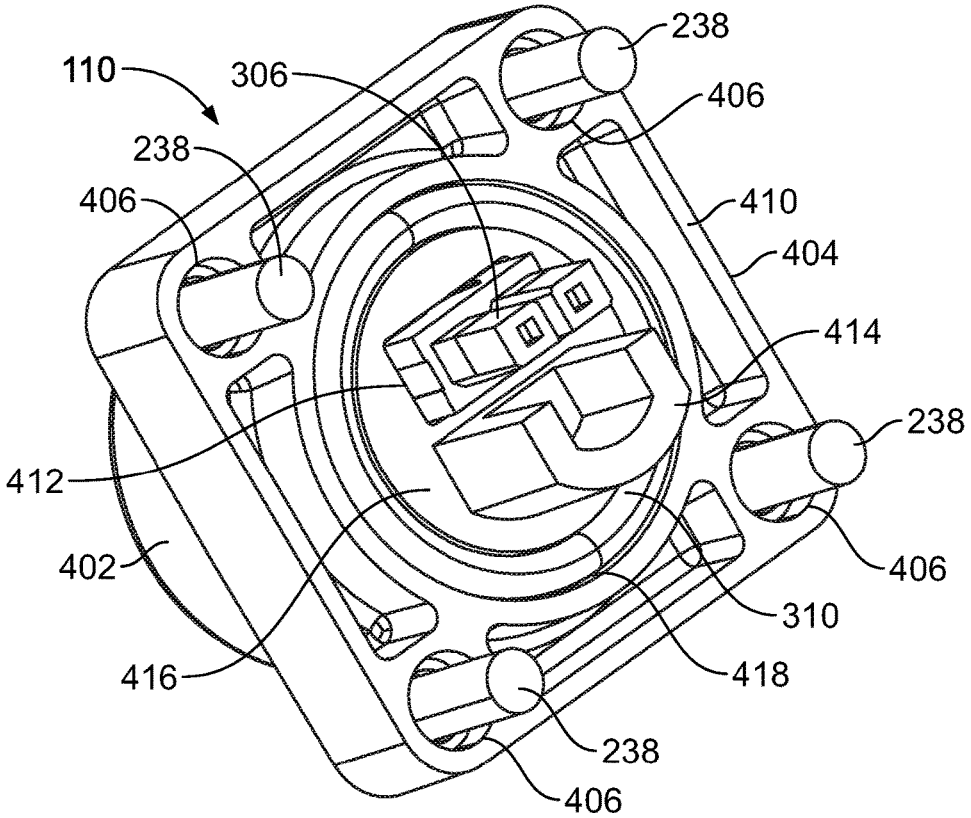
FIG. 4B is another perspective view of the example visual indicator of FIGS. 3 and 4A.

FIGS. 4A and 4B are isometric views of the example visual indicator 110 of FIGS. 1, 2 and 3. Referring to FIGS. 4A and 4B, the visual indicator 110 includes a cap, lens or cover 402 that is removably coupled to a base 404. The base 404 of the example visual indicator 110 includes apertures 406 to receive the respective fasteners 238. The apertures 406 of the base 404 extend between a first side 408 (FIG. 4A) of the base 404 and a second side 410 (FIG. 4B) of the base 404 opposite the first side 408. The base 404 includes the connector 306 extending through an opening 412 of the base 404. The second side 410 of the base 404 of the illustrated example employs an orientation member, male connector and/or protrusion 414 protruding from a bottom surface 416 of the base 404. As discussed below, the orientation member 414 facilitates proper orientation and/or alignment between the connectors 306 and 308 (FIG. 3) when the visual indicator 110 is coupled to the light panel 222 of the control panel 100. In this example, the base 404 includes a channel 418 formed in the bottom surface 416 and/or the second side 410 of the base 404 to receive the seal 310. The cover 402 and/or the base 404 may be composed of metal, plastic and/or any other suitable material(s). In some examples, at least a portion of the cover 402 is a transparent.

Figure 5:
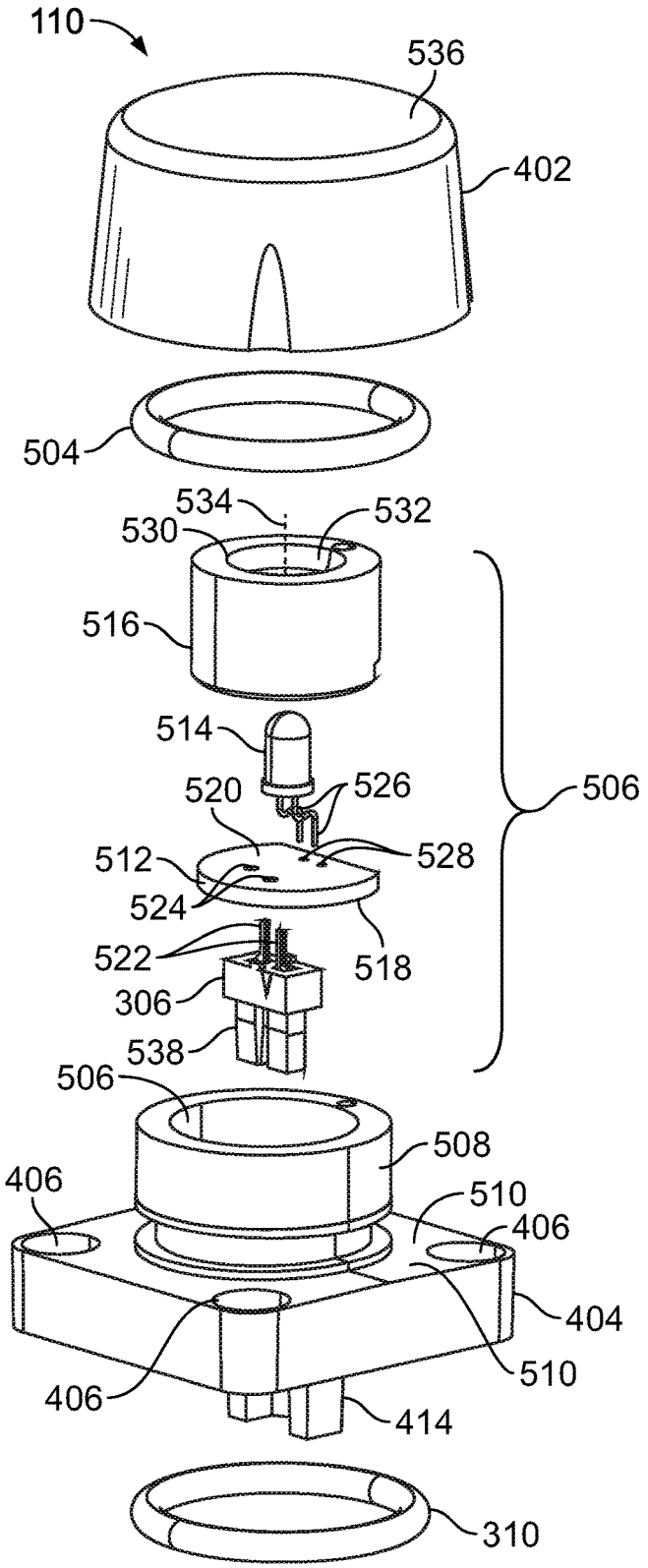
FIG. 5 is an exploded view of the example visual indicator of FIGS. 3, 4A and 4B.

FIG. 5 is an exploded view of the example visual indicator 110 of FIGS. 4A and 4B. The example visual indicator 110 of the illustrated example includes the cover 402, the base 404, the seal 310, a light assembly 502 and a seal 504 (e.g., an O-ring). The base 404 of the illustrated example includes a cavity or light chamber 506 defined by a wall 508 protruding from a flanged surface 510 of the base 404. The light chamber 506 receives at least a portion of the light assembly 502. In some examples, the light assembly 502 includes the connector 306, a support plate 512, a light source 514 (e.g., a light bulb, a light emitting diode or LED, a fiber optic light, etc.) and/or a reflector 516. The connector 306 is attached to a first side 518 of the support plate 512 and the light source 514 is attached to a second side 520 of the support plate 512 opposite the first side 518 (e.g., via soldering). Prongs 522 of the connector 306 are positioned through openings 524 of the support plate 512 and prongs 526 of the light source 514 protrude through openings 528 of the support plate 512 to enable the prongs 526 to be electrically coupled to the connector 306. The reflector 516 includes an opening 530 defining an inner surface 532 that is angled, tapered and/or otherwise tilted relative to a longitudinal axis 534 of the opening 530 and/or the reflector 516. The inner surface 532 helps reflect light emitted by the light source 514 to increase an illumination intensity of the visual indicator 110. For example, the reflector 516 channels light emitted by the light source 514 through an upper surface or upper end 536 of the cover 402. When the light assembly 502 is positioned within the light chamber 506, at least a portion 538 of the connector 306 protrudes from the base 404 adjacent the orientation member 414.

In the illustrated example, the light source 514 illuminates a clear or white color light and the cover 402 of the illustrated example is a colored lens (e.g., a transparent lens composed of plastic) having a first color such as, for example, green. In this manner, to change a color output of the visual indicator 110, the cover 402 may be interchanged with another cover having a different colored lens. As a result, a color output of any one of the visual indicators 110*a*-110*d* (FIG. 1) of the example control panel 100 may be changed without having to remove the base 404 of the respective visual indicators 110*a-d* from the light panel 222. However, in other examples, the light source 514 is colored (e.g., not clear or white) and the cover 402 is clear, white and/or transparent. In some examples, the light source 514 is a colored light (e.g., red, green, etc.) and the cover 402 is a colored lens (e.g., red, green, semi-transparent red color, etc.)

In some examples, the cover 402 of the illustrated example is removably coupled to the base 404 via, for example, threads. For example, the wall 508 adjacent the flanged surface 510 includes a threaded portion 542 and a portion of the cover 402 adjacent an end 544 of the cover 402 includes a threaded portion. In the illustrated the seal 504 is positioned within an annular recess 546 formed on the wall 508 adjacent the threaded portion 542 and provides a seal between the wall 508 (e.g., an outer surface of the wall 508) and the cover 402 (e.g., an inner surface of the cover 402) when the cover 402 is coupled to the base 404. The seal 504 helps provide ingress protection by preventing, substantially preventing and/or deterring contaminates or harsh environmental conditions (e.g., salt, dust, sand, etc.) from entering the light chamber 506 of the base 404. In some examples, the cover 402 is coupled to the base 404 via friction fit, a locking pin, and/or any other suitable fastener(s) to enable the cover 402 to be removably coupled relative to the base 404.

Figure 6:
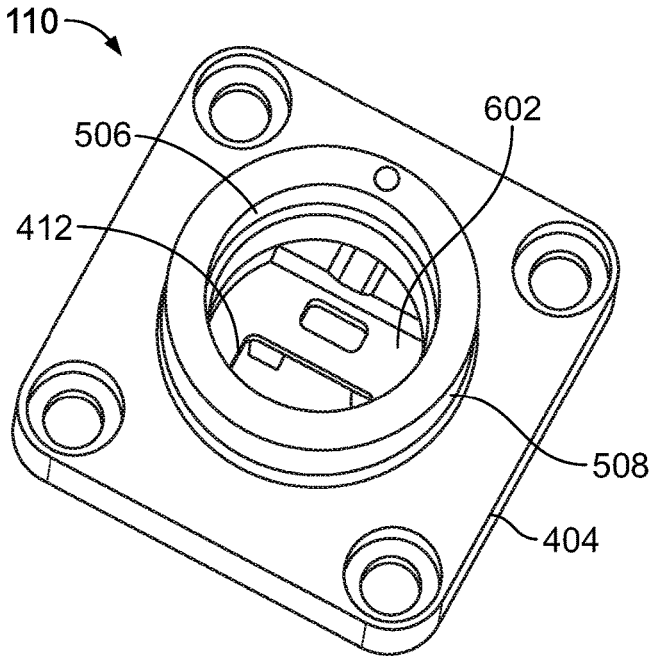
FIG. 6 is a perspective view of a base of the example visual indicator of FIGS. 3, 4A, 4B, and 5.

FIG. 6 is a perspective view of the example base 404 of FIGS. 4A, 4B and 5. Referring to FIG. 6, the light chamber 506 includes a bottom wall or portion 602 to receive and/or support the support plate 512 (FIG. 5) of the light assembly 502. The bottom wall 602 of the example base 404 of FIG. 6 includes the opening 412 to enable the connector 306 to pass through the second side 410 of the base 404.

Figure 7:
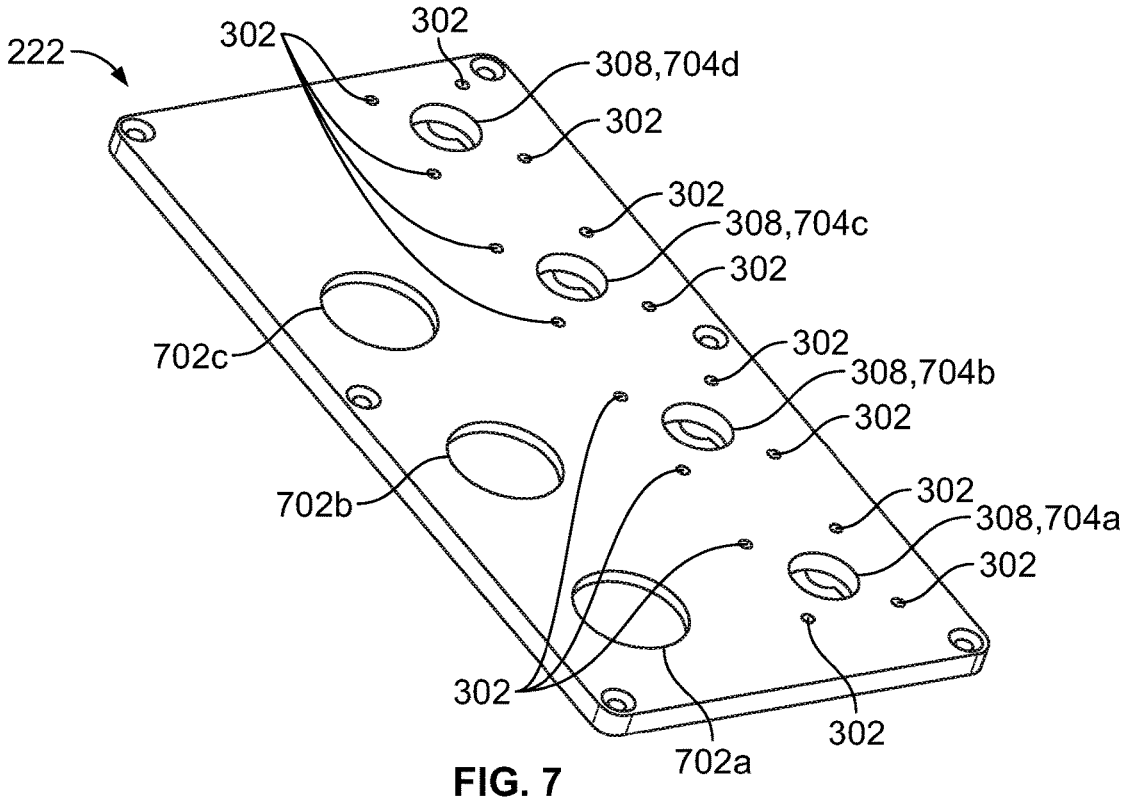
FIG. 7 is a perspective view of an example light panel of the example control panel of FIGS. 1, 2 and 3.

FIG. 7 is a perspective view of the light panel 222 of FIG. 1. The light panel 222 of the illustrated example includes openings 702*a-c* to enable the respective buttons 106*a-c* to pass therethrough. In the illustrated example, the light panel 222 includes the openings 308 to receive respective connectors 306 of the visual indicators 110. In particular, the light panel 222 includes openings 704*a-d* to receive of the respective visual indicators 110*a-d*. In the example, each of the openings 308 is surrounded by the openings 302 (e.g., blind holes) that receive the fasteners 238 of the visual indicator 110 to enable the visual indicator 110 to be coupled to the light panel 222.

Figure 8:
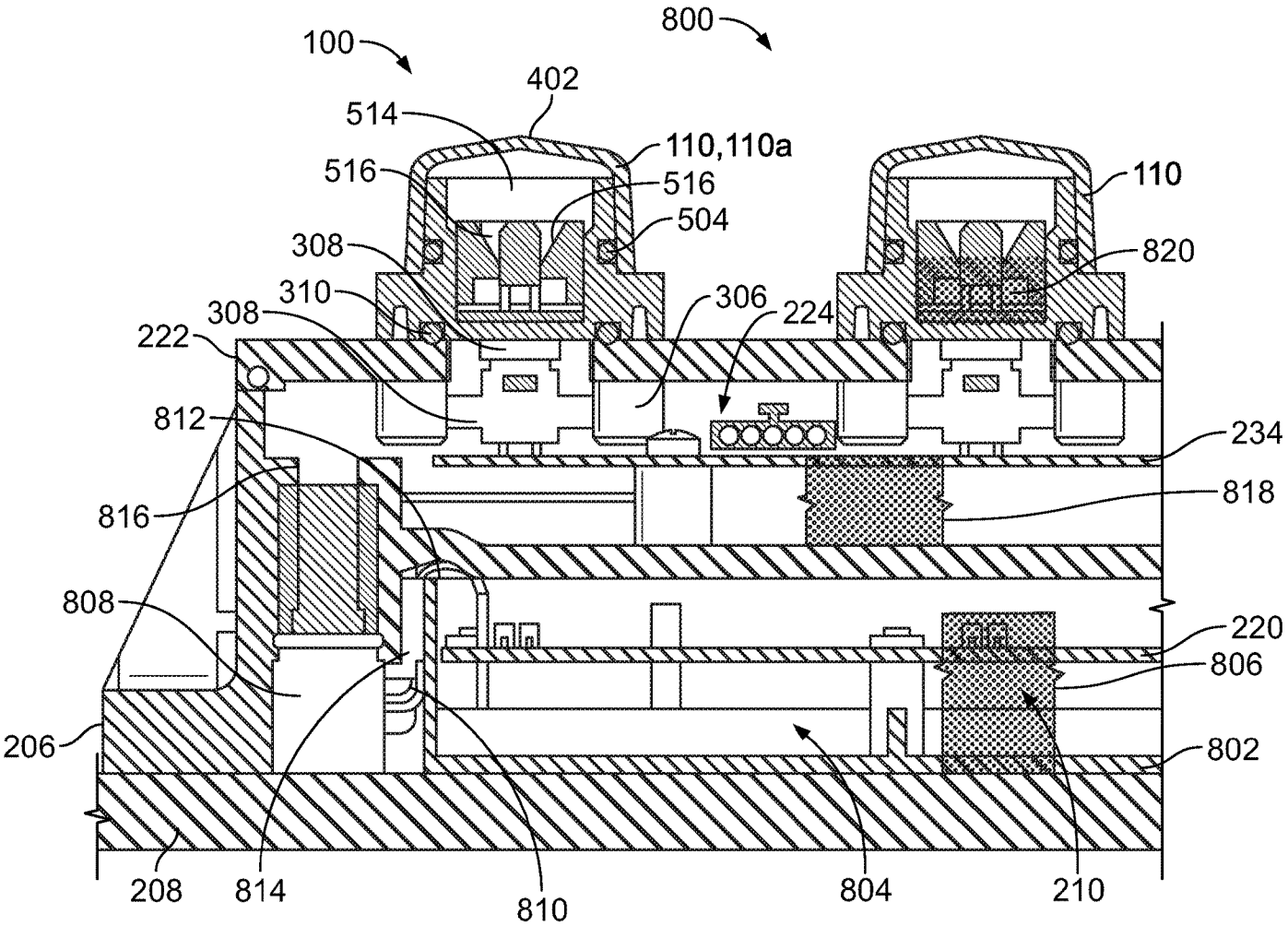
FIG. 8 is a partial cross-sectional view of the example control panel 100 of FIGS. 1, 2 and 3.

FIG. 8 is a partial cross-sectional assembly view 800 of the example control panel 100 of FIG. 1. As shown in the example of FIG. 8, the main cavity 210 is fluidly isolated or separated from the secondary cavity 224. More specifically, in the illustrated example, the housing 206, which is composed of and/or includes metal and/or another material (e.g., plastic, composite, etc.), separates and/or provides a barrier between the main cavity 210 and the secondary cavity 224. In this example, the electronics enclosure 218 is positioned within the main cavity 210 and is separated from the secondary cavity 224 via the housing 206. The electronics enclosure 218 includes a housing 802 to form a potting chamber or potting cup 806. As shown in the example of FIG. 8, the electronic components 220 are positioned in the potting chamber or cup 804, which is filled with a potting material 806 (e.g., potting or polyester) to encapsulate the electronic components 220. In the illustrated example, the potting chamber 804 is shown partially filled with the potting material 806. However, in some examples, the potting chamber 804 is entirely filled with the potting material 806. The electronics enclosure 218 is factory sealed and the housing 206 is coupled or sealed to the rear cover 208 to ensure and/or enable compliance with the certain ingress protection classification(s) (e.g., IP66). The secondary cavity 224 encloses the electronic components 234 associated with the visual indicators 110. For example, the secondary cavity 224 houses the connector 308 that receives the visual indicators 110. In this example, each of the connectors 308 is accessible via the respective openings 304 formed through the light panel 222. As noted above, the opening 302 that receive the fasteners 238 of the visual indicators 110 are formed as blind holes that have enclosed ends to prevent or restrict fluid communication between the opening 302 and the secondary cavity 224.

In the illustrated example, an electrical coupler 808 (e.g., a third circuit board or other connector) electrically and/or operatively couples the electronic components 220 positioned in the main cavity 210 and the electronic components 234 positioned in the secondary cavity 224. As shown in the example of FIG. 8, the electrical coupler or insert 808 is coupled (e.g., threaded) to the housing 206 and is positioned between the main cavity 210 and the secondary cavity 224. More specifically, the electrical coupler 808 is positioned outside of the main cavity 210. The electrical coupler 808 is coupled to the electronic components 220 of the main cavity 210 via wires 810 positioned through a channel 812. The channel 812 is sealed with a seal 814 to prevent and/or deter fluid communication between an area outside the electronics enclosure 218 and the potting chamber 806 of the electronics enclosure 218. The electrical coupler 808 is electrically coupled to the electronic components 234 in the secondary cavity 224 via an access port 816 formed in the housing 206 in an area outside of a dimensional envelope of the main cavity 210.

Further, the seal 310 of the visual indicator 110 fluidly isolates and/or seals the secondary cavity 224 from environmental conditions (e.g., salt, dust, etc.) when the control panel 100 is in the assembled state 300. Similarly, the seal 504 of the visual indicator 110 fluidly isolates and/or seals the light chamber 506 from environmental conditions (e.g., salt, dust, etc.) when the cover 402 is coupled to the base 404. Thus, when the control panel 100 is factory sealed, the main chamber 210 and/or the secondary cavity 224 may be configured to comply and/or meet certain ingress protection ratings (e.g., IP66 ratings). In some examples, the secondary cavity 224 may also include ingress protection material 818 (e.g. potting) to comply and/or meet certain ingress protection ratings (e.g., IP66 ratings). In some examples, the light chamber 506 and/or the support plate 512 may include a seal (e.g., a gasket overlay positioned on the support plate, an O-ring, etc.) and/or the visual indicator 110 may include ingress protection material 820 (e.g., potting) to help further prevent, substantially prevent and/or deter ingress of contaminates into the secondary cavity 224 via the opening 412 and the light chamber 506 when the cover 402 is removed from the base 404 is harsh conditions.

Figure 9:
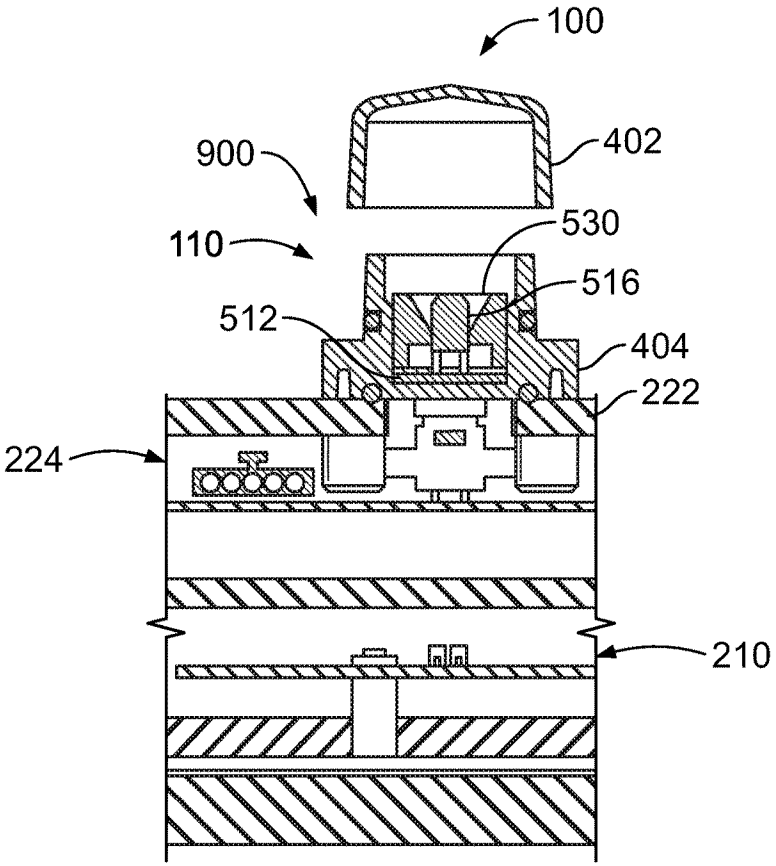
FIG. 9 is a partial cross-sectional view of the example visual indicator of FIGS. 1, 2, 3, 4A, 4B and 5 shown removed from the example control panel of FIGS. 1, 2 and 3.
Figure 11:
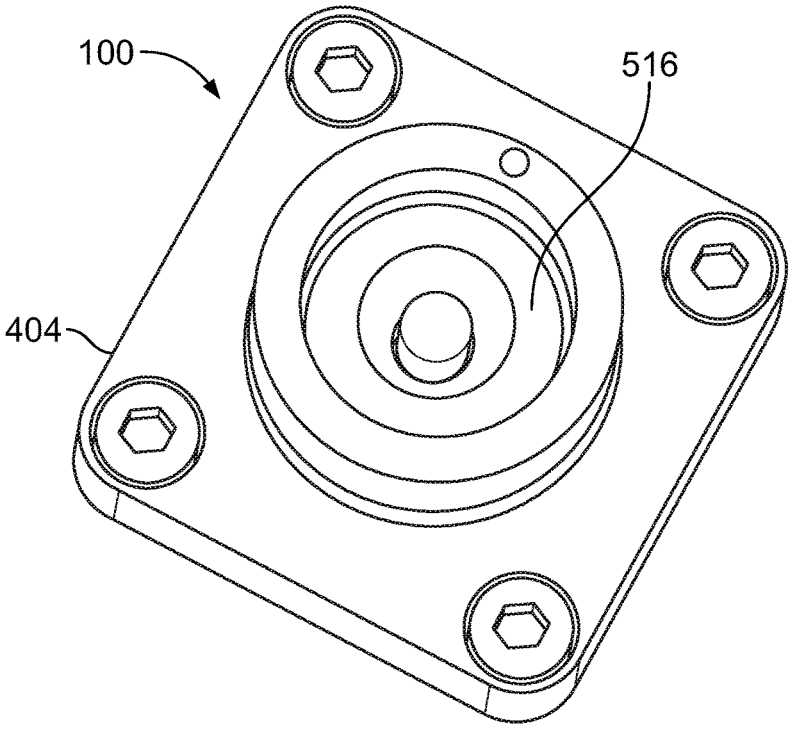
FIG. 11 is a perspective view of the example visual indicator of FIGS. 4A, 4B and 5 without the cover.
Figure 12:
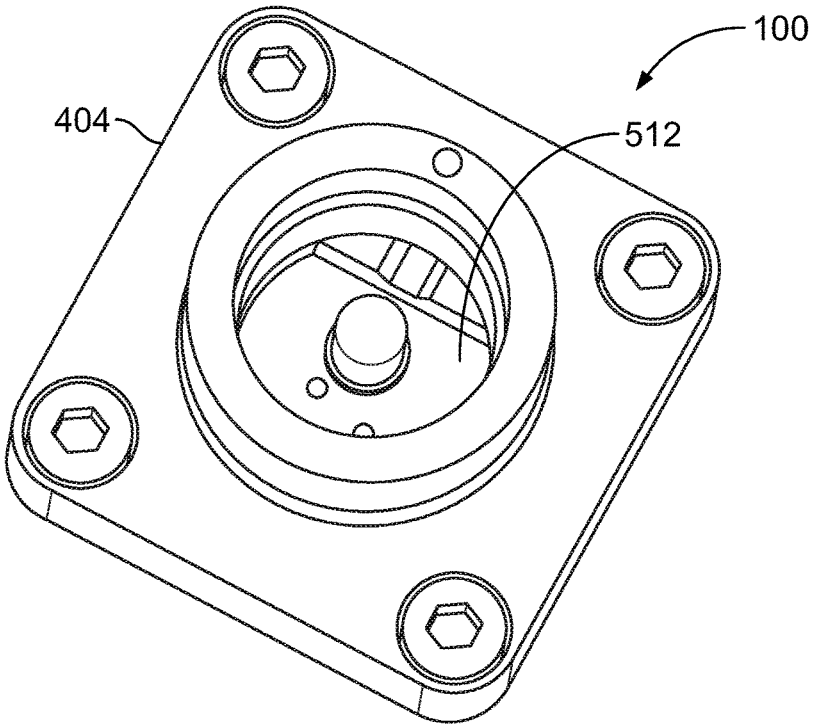
FIG. 12 is a perspective view of the example visual indicator of FIGS. 4A, 4B and 5 without the cover and without a reflector.

FIG. 9 illustrates the example control panel 100 in partially assembled state 900 showing the cover 402 of visual indicator 110 removed from the base 404 while the base 404 remains attached to the light panel 222 and/or the control panel 100. In this example, the cover 402 of the illustrated example is a colored lens having a first color such as a green color (e.g., the visual indicator 110*a* of FIG. 1). To change a color output of the visual indicator 110, the cover 402 may be interchanged with another cover having a different colored lens (e.g., red, blue, yellow, etc.). As a result, the visual indicators 110 of the control panel 100 may be modified in the field without having to remove the visual indicator 110 from the light panel 222. When the cover 402 is removed, the reflector 516 and/or the support plate 512 and/or potting disposed adjacent the support plate 512, the reflector 516 and/or within the light chamber 506 provides a substantially sealed barrier to restrict or prevent ingress of contaminates externally from the control panel 100 from flowing into the secondary cavity 224 via the light chamber 506. For example, FIG. 11 illustrates the example visual indicator 110 having the cover 402 removed and FIG. 12 illustrates the example visual indicator 110 having the cover 402 and the reflector 516 removed from the base 404 to show the support plate 512 positioned within the light chamber 506. As a result, the control panel 100 (i.e., the secondary cavity 224 and the main cavity 210) retains an original or manufactured ingress protection and/or certification rating. Thus, in this example, the example visual indicator 110 facilitates color interchangeability in the field without affecting an ingress protection and/or a classification rating of the control panel 100 when the cover 402 is removed from the base 404.

Figure 10:
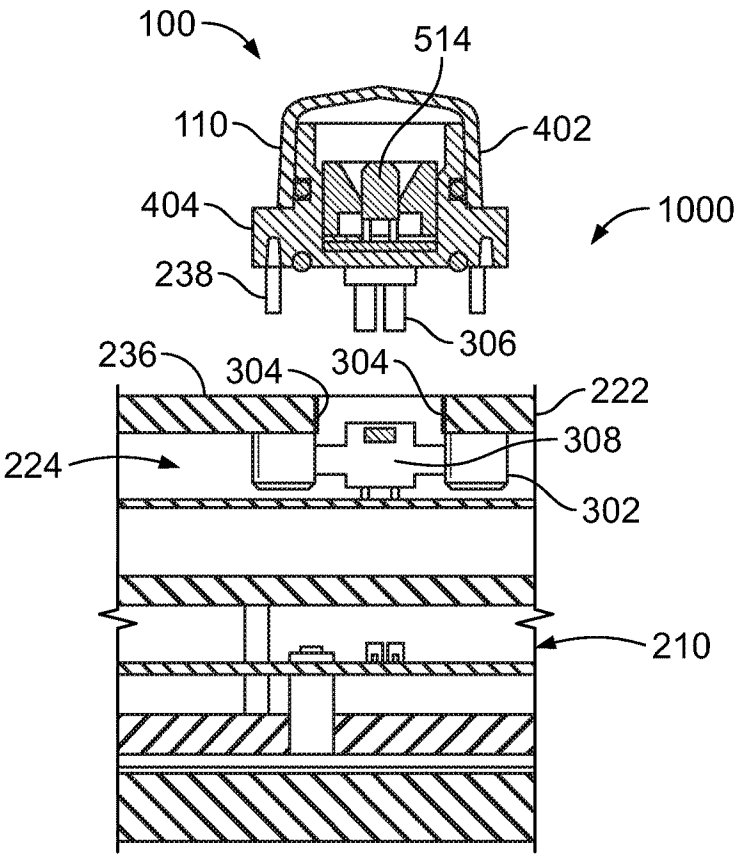
FIG. 10 is a partial cross-sectional view of the example control panel of FIGS. 1, 2 and 3 showing a cover removed from the visual indicator while the visual indicator is coupled to the example control panel.

FIG. 10 the example control panel 100 in another partially assembled state 1000 showing the visual indicator 110 removed from the light panel 222. To remove the visual indicator 110 from the light panel 222, the fasteners 238 are removed or unscrewed from the apertures 302 of the light panel 222. The visual indicator 110 may be moved away from the outer surface 236 of the light panel 222 such that the connector 306 disengages or decouples from the connector 308 of the secondary cavity 224 and the base 404 is separated from the light panel 222. In some examples, the visual indicator 110 of FIG. 10 may be removed from the control panel 100 and/or the light panel 222 in the field when the light source 514 is no longer operable and/or requires replacement. Thus, the visual indicator 110 may be interchanged with another visual indicator. In some examples, the replacement visual indicator is substantially identical to the visual indicator 110 and/or includes a different component such as a different colored lens and/or a different colored bulb. As a result of decoupling the visual indicator 110 from the light panel 222, the opening 304 is exposed to environmental conditions external to the control panel 100. Thus, when the visual indicator 110 is removed from the light panel 222 in the field, contaminates or other harsh environmental conditions may ingress the secondary cavity 224 via the opening 304. However, although the secondary cavity 224 may be exposed to harsh environmental conditions, because of the housing 206, ingress protection material or potting material within the main cavity 210, the main cavity 210 remains sealed and/or fluidly isolated from the secondary cavity 224. Therefore, although the secondary cavity 224 may be exposed to external conditions, the main cavity 210 retains an ingress protection rating (e.g., an IEC IP66 rating). As noted above in connection with FIG. 8, the secondary cavity 224 may include potting material and/or other ingress protection material 818 to maintain an ingress protection rating when the visual indicator 110 is removed from the light panel 222.

Figure 13:
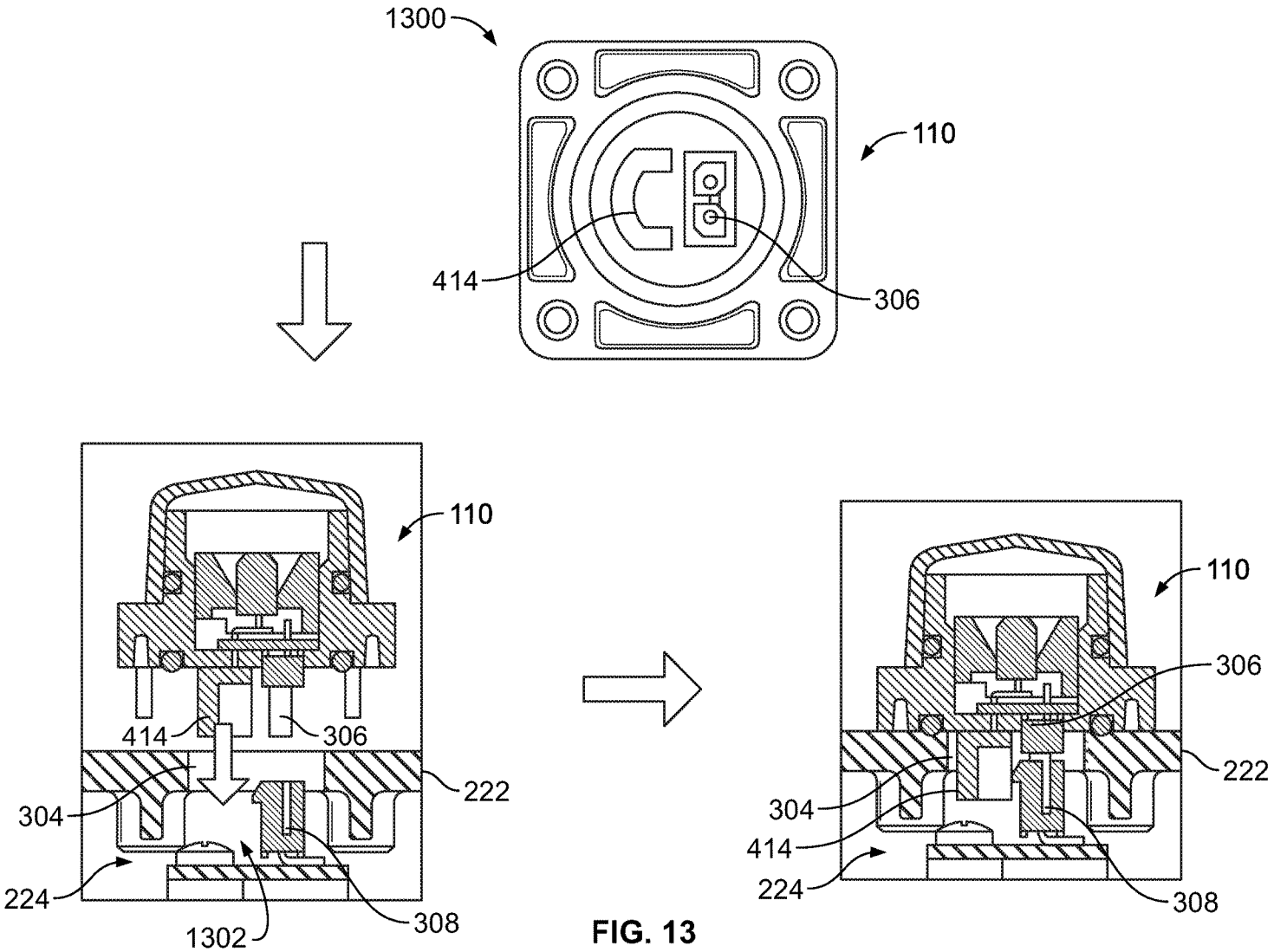
FIG. 13 illustrates an example method of coupling the example visual indicator to the example control panel disclosed herein.

FIG. 13 illustrates a method 1300 of coupling the visual indicator 110 to the light panel 222. As noted above, the orientation member 414 of the base 404 ensures and/or facilitates alignment between the visual indicator 110 and the light panel 222. More specifically, the orientation member 414 facilitates alignment between the connector 306 and the connector 308 when the visual indicator 110 is coupled to the light panel 222. In particular, the orientation member 414 provides a key to enable only one orientation of the visual indicator 110 to properly couple the visual indicator 110 and the light panel 222. Additionally, the orientation member 414 provides a guide when coupling the visual indicator 110 and the light panel 222. The orientation member 414, along with at least the portion 538 of the connector 306 of the base 404, are positioned in the opening 304 of the light panel 222 when the visual indicator 110 is coupled to the light panel 222. In particular, the orientation member 414 is positioned in a space 1302 of the secondary cavity 224 adjacent the connector 308. In the orientation of FIG. 13, the orientation member 414 is on the left hand side of FIG. 13 and the connector 306 is positioned on the right hand side of FIG. 13. The orientation member 414 of the illustrated example has a C-shaped profile to help facilitate proper orientation of the visual indicator 110 relative to the light panel 222. However, in some examples, the orientation member 414 may have any other shape or profile.

Figure 14:
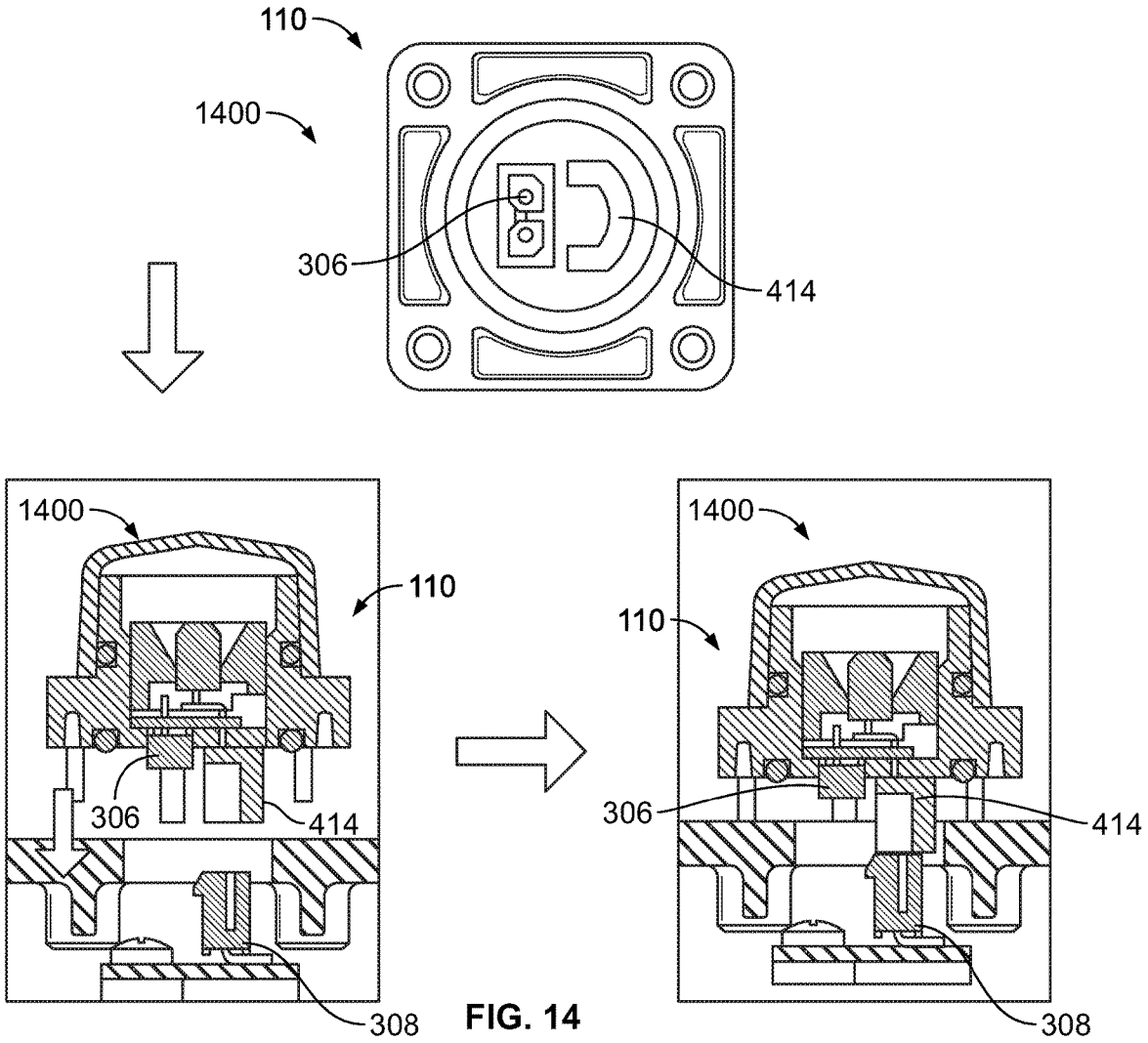
FIG. 14 illustrates the example visual indicator in an improper orientation relative to the example control panel.

FIG. 14 illustrates the visual indicator 110 when the orientation member 414 is in an improper orientation 1400 (e.g., not properly aligned) relative to the light panel 222. For example, when the orientation member 414 is not properly aligned, the orientation member 414 prevents the bottom surface 416 and/or the seal 310 of the base 404 from engaging the outer surface 236 of the light panel 222. In some instances, the orientation member 414 provides an interference with, for example, the connector 308 of the secondary cavity 224 when the orientation member 414 is not properly oriented within the opening 304. In some examples, the orientation member 414 may be omitted. In some such examples, to provide an orientation guide, the openings 406 of the base 404 and the openings 302 of the light panel 222 may be configured in a pattern (e.g., an asymmetric pattern) that enables coupling of the visual indicator 110 in one orientation and/or direction relative to the opening 304 such that the connector 306 aligns with the connector 308.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A visual indicator for use with a control panel comprising:

a base defining a light chamber;

a first cover removably coupled to the base to cover the light chamber; and a light assembly positioned in the light chamber of the base, the light assembly having a first connector projecting from the base, the first connector to pass through an access opening formed in an outer surface of the control panel when the visual indicator is coupled to the control panel, the base to engage the outer surface of the control panel when the visual indicator is coupled to the control panel, the visual indicator to enable an ingress protection rating of the control panel to be maintained when at least one of the visual indicator is removed from the control panel or the first cover of the visual indicator is replaced with a second cover different than the first cover.

2. The visual indicator of claim 1, wherein the first cover defines a first lens having a first color.

3. The visual indicator of claim 2, further including a second cover defining a second lens having a second color different than the first color.

4. The visual indicator of claim 1, wherein the base includes a wall projecting from a first side of the base, the wall having an opening to define the light chamber.

5. The visual indicator of claim 4, wherein the base includes a projection from a second side of the base opposite the first side to facilitate alignment between the visual indicator and the control panel when the visual indicator is coupled to the control panel.

6. The visual indicator of claim 5, wherein the light assembly includes a light source coupled to a first side of a support plate and a connector coupled to a second side of the support plate opposite the first side.

7. The visual indicator of claim 6, wherein the light source is positioned in the light chamber and the connector protrudes from the second side of the base.

8. The visual indicator of claim 6, wherein the light assembly further includes a reflector positioned in the light chamber.

9. A control panel assembly comprising:

a first housing portion having a rear cover removably coupled to a first side of a housing to form a main cavity, the main cavity to house a first printed circuit board;

a light panel removably coupled to a second side of the housing to define a secondary cavity, the secondary cavity to house a second printed circuit board, the second printed circuit board being electrically coupled to the first printed circuit board, the light panel having an access port through an outer surface of the light panel to enable access to a first electrical connector positioned in the secondary cavity; and a visual indicator removably coupled to the outer surface of the light panel, the visual indicator having a light assembly including a second connector, the second connector to couple to the first connector positioned in the secondary cavity via the access port when the visual indicator is coupled to the light panel, wherein an ingress protection rating of the main cavity is not affected when the visual indicator is removed from the light panel.

10. The control panel of claim 9, wherein the main cavity is fluidly isolated from the secondary cavity.

11. The control panel of claim 10, wherein the visual indicator is removably coupled to the light panel without having to remove the light panel from the housing.

12. The control panel of claim 11, wherein the visual indicator is removably coupled to the light panel without having to remove the housing from the rear cover.

13. The control panel of claim 9, wherein the visual indicator includes a first cover removably coupled to a base, the base defining a light cavity to receive the light assembly.

14. The control panel of claim 13, wherein the light assembly includes a light source electrically coupled to the second connector, the light source to provide light when the second connector is coupled to the first connector positioned in the secondary cavity.

15. The control panel of claim 13, wherein the base further includes a projection from a bottom surface of the base to orient the visual indicator relative to the light panel to enable the first connector to couple with the second connector.

16. The control panel of claim 15, wherein the projection is adjacent the second connector.

17. The control panel of claim 15, wherein the bottom surface of the base engages the outer surface of the light panel when the visual indicator is coupled to the light panel such that the projection and the second connector project through the access port when the visual indicator is coupled to the light panel.

18. The control panel of claim 13, wherein the first cover defines a first lens having a first color.

19. The control panel of claim 18, further includes a second cover defining a second lens having a second color different than the first color, the first cover being interchangeable with the second cover.

20. The control panel of claim 19, wherein an ingress protection rating of the control panel is not affected when the first cover is interchanged with the second cover.

21. A visual indicator assembly comprising:

a base having a flange, a wall projecting from a first side of the flange to define a light chamber, and an opening formed in a second side of the flange in communication with the light chamber;

a support plate coupled to the base, the support plate supported by a platform formed in the light chamber;

a light source coupled to the support plate and positioned within the light chamber;

a first connector coupled to the support plate and projecting through the opening formed in the second side of the flange, the first connector being electrically coupled to the light source; and a first lens removably coupled to the base, the first lens to cover the light chamber when the first lens is coupled to the base, the first lens being interchangeable with a second lens different than the first lens when the base is coupled to a control panel, wherein an ingress protection rating of the control panel is not affected when the first lens is interchanged with the second lens.

22. The visual indicator assembly of claim 21, further including an orientation member projecting from the second side of the flange.

23. The visual indicator assembly of claim 22, wherein the orientation member is positioned adjacent the first connector.

24. The visual indicator assembly of claim 21, further including a first seal coupled to the second side of the base.

25. The visual indicator assembly of claim 24, further including a second seal positioned between the first lens and the wall.

* * * * *